United States Patent [19]

Sawyer et al.

[11] 4,410,402

[45] Oct. 18, 1983

[54] DEGRADATION OF HALOGENATED CARBON COMPOUNDS

[75] Inventors: Donald T. Sawyer, Riverside; Julian L. Roberts, Jr., Redlands, both of Calif.

[73] Assignee: Regents of the University of California, Berkeley, Calif.

[21] Appl. No.: 221,077

[22] Filed: Dec. 29, 1980

[51] Int. Cl.[3] ..... C25B 3/02

[52] U.S. Cl. ..... 204/59 R

[58] Field of Search ..... 204/59 R, 72–81

[56] References Cited

U.S. PATENT DOCUMENTS 3,677,916 7/1972 Seiber et al. ..... 204/59 R

OTHER PUBLICATIONS

Org. Electrode Processes by Allen, pp. 90, 91, pub. by Chapman & Hall Ltd., London (1958).

Intro. to Org. Electrochem by Rifi et al., pp. 214, 215, pub. by Marcel Dekker, Inc., New York (1974).

Fry et al., J. Org. Chem., vol. 41, No. 1, pp. 54–57 (1976).

"The Chemistry of Superoxide Ion", Sawyer, D. T. & Gibian, N. J.; *Tetrahedron,* vol. 35, 1979, pp. 1471–1481.

"Electrochemical Studies of the Reactivity of Superoxide Ion with Several Alkyl Halides in Dimethyl Sulfoxide", Merritt, M. V., Sawyer, D. T.; *Journ. of Organic Chemistry,* 35, 1970, pp. 2157–2159.

"Nucleophilic Reactions of Electrogenerated Superoxide Ion", Dietz, R.; Forno, A. E. G.; Larcombe, B. E. & Peover, M. E.; *Journ. Chem. Soc.,* B, 1970, pp. 816–820.

"The Reaction of Superoxide with Alkyl Halides and Tosvlates", Chern, C–I.; San Filippo, Jr., J.; Valentine, J. S.; *J. Org. Chem.* vol. 40, No. 11, 1975, pp. 1678–1680.

"Superoxide Chemistry, A Convenient Synthesis of Dialkyl Peroxides"; Johnson, R. A.; Nidy, E. G.; *J. Org. Chem.,* vol. 40, No. 11, 1975, pp. 1680–1681.

"Cleavage of Esters by Superoxide"; Chern, C–I.; San Filippo, Jr., J.; Romano, L. J.; J. Org. Chem., vol. 41, No. 3, 1976, pp. 586–588.

"On the Reaction Kinetics of Electrogenerated Superoxide Ion with Aryl Benzoates"; Bontempelli, G; Magno, F.; *J. Electroanal. Chem.,* 68, 1976, pp. 337–344.

"Reactivity of Superoxide Ion with Carbonyl Compounds in Aprotic Solvents"; Gibian, M. J.; Morrison, M. M.; Sawyer, D. T.; Tangpoonpholvivat, R.; Ungermann, T.; *J. American Chem. Soc., 101:3,* 1979, pp. 640–644.

"A Study of the Reaction Kinetics of Electrogenerated Superoxide Ion with Benzylbromide"; Magno, F.; Seeber, R.; Valcher, S.; *J. Electroanal. Chem.,* 83, 1977, pp. 131–138.

"Nucleophilic Reactions of Superoxide Anion Radical"; Arudi, R. L.; Danen, W. C.; Warner, R. J.; *Organic Free Radicals, ACS Symposium Series 69;* Prior, W. A., ed.; 1978, pp. 244–257.

"The Electrochemical Reduction of Superoxide Ion and Oxidation of Hydroxide Ion in Dimethyl Sulfoxide"; Goolsby, A. D.; Sawyer, D. T.; *Analytical Chemistry,* vol. 40, No. 1, 1968, pp. 83–86.

Advanced Organic Chemistry; March J.; 2nd ed.; McGraw–Hill, New York, 1977, pp. 342–343.

"Mechanisms of Protection Against the Damage Produced in Biological Systems by Oxygen–Derived Radicals"; Slater, T. F.; *Oxygen Free Radicals and Tissue Damage; Ciba Foundation Symposium 65;* Elsevier/-North–Holland, New York, 1979, pp. 143–163.

*Experimental Electrochemistry for Chemists;* Sawyer, D. T.; Robert, J. L., Jr.; John Wiley & Sons, New York, 1974, pp. 167–215 (Chapter Four).

*Primary Examiner*—F. Edmundson

*Attorney, Agent, or Firm*—Nilsson, Robbins, Dalgarn, Berliner, Carson & Wurst

[57] ABSTRACT

Halogenated carbon compounds containing at least three halogen atoms and capable of undergoing bimolecular nucleophilic substitution are degraded by reaction in an aprotic solvent with a strong nucleophile selected from superoxide ion and hydroxide ion. The process is particularly applicable to compounds in which at least three halogen atoms are covalently joined to a tetrahedral carbon atom. In a specific embodiment, superoxide ion is electrolytically generated in an aprotic solvent containing a soluble organic electrolyte. In a further embodiment, the aprotic solvent is dimethyl sulfoxide, which, when converting carbon tetrahalide, forms dimethylsulfone and carbonate.

14 Claims, 1 Drawing Figure

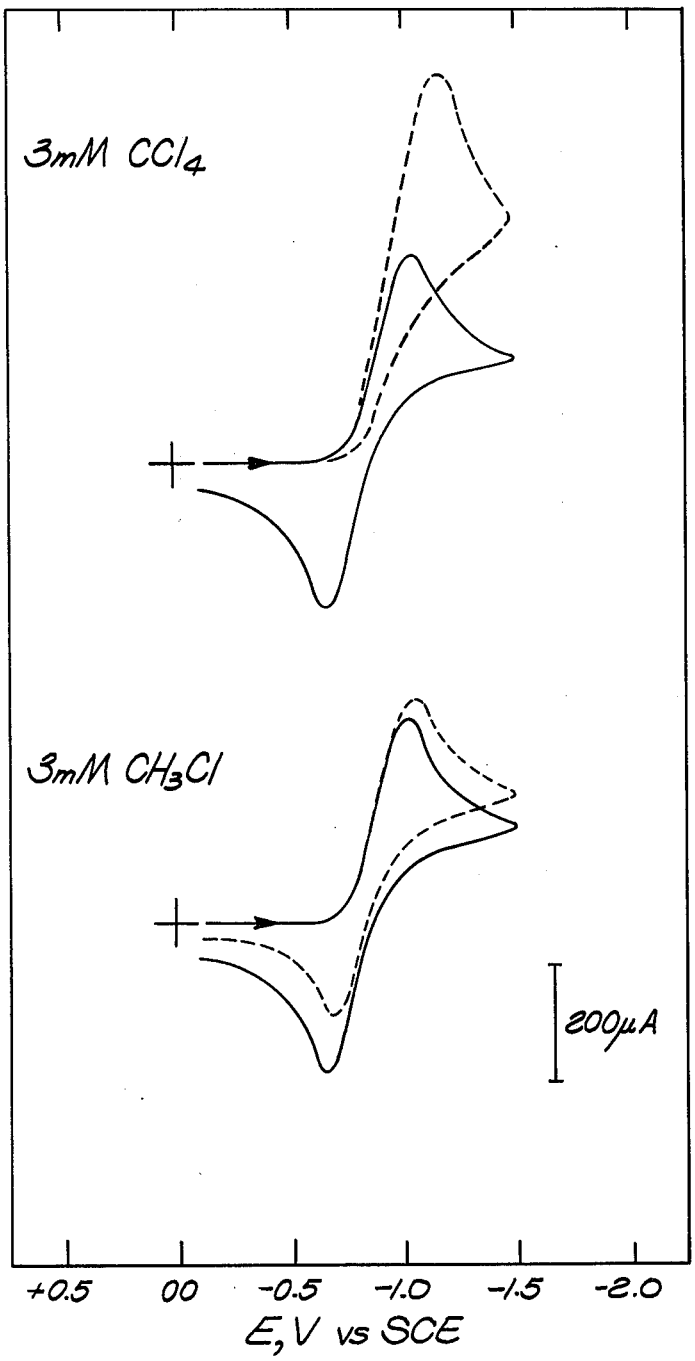
3mM CCl4
3mM CH3Cl
200μA
+0.5
00
-0.5
-1.0
-1.5
-2.0
E, V vs SCE

DEGRADATION OF HALOGENATED CARBON COMPOUNDS

ACKNOWLEDGEMENT

The Government has rights in this invention pursuant to Grant No. CHE-7922040 awarded by the National Science Foundation.

FIELD OF THE INVENTION

The invention pertains to the fields of oxidation processes and electrolytic material treatment.

BACKGROUND AND SUMMARY OF THE INVENTION

Toxic halogenated compounds significantly contribute to the problem of disposing of chemical wastes. Such wastes are either shipped hundreds of miles from shore to be incinerated or are stored in dumps for toxic wastes. In the past, negligence in locating such dumps has had catastrophic consequences in exposing large populations to the adverse health affects of toxic compounds. As a result, massive clean-up efforts are being undertaken to degrade and detoxify these compounds.

There is thus a clear need for an efficient and safe method to degrade toxic halogenated waste to harmless and environmentally compatible products. However, such a method has been elusive because of certain basic considerations with respect to the nature of toxic halogenated compounds. One aspect of the problem relates to the wide diversity of such compounds, ranging from such simple molecules as carbon tetrachloride and chloroform to complex insecticides such as p-p'-dichlorodiphenyltrichloroethane (p-p'-DDT). Another aspect of the problem relates to the theoretical consideration that as one increases the number of halogen atoms covalently joined to a tetrahedral carbon atom, one should experience a striking decrease in reactivity of the halogen atoms as a result of increasing steric hindrance to inversion of the tetrahedral configuration. This is consistent with a mechanism involving bimolecular nucleophilic substitution ($S_N2$); see San Fillipo, J., Jr.; Chern, C.-I.; Valentine, J. S.; "The Reaction of Superoxide with Alkyl Halides and Tosylates", *J. Org. Chem.*, 1975, 40, 1678, and Johnson, R. A.; Nidy, E. G.; "Superoxide Chemistry. A Convenient Synthesis of Dialkyl Peroxides", *J. Org. Chem.*, 1975, 50, 1680. Indeed, the value of the second order rate constant for the reaction of $KO_2$ with methyl bromide ($670\pm20M^{-1}s^{-1}$) is more than 50 times greater than a similar reaction with methylene bromide ($12.8\pm0.2M^{-1}s^{-1}$), as reported by Danen, W. C.; Warner, R. J.; Arudi, R. L. in "Nucleophilic Reactions of Superoxide Anion Radical", *Organic Free Radicals; ACS Symposium Series* 69; Pryor, W. A., ed.; 1978; pp. 244-257. Our own experiments show that methyl chloride ($80\pm10M^{-1}s^{-1}$) reacts with superoxide ion in an aprotic solvent about nine times faster than methylene chloride ($9\pm12M^{-1}s^{-1}$).

In the Danen et al article the decrease in reactivity upon halogen substitution in the alpha position is attributed, at least in part, to steric hindrance, and closely related thereto, the effect called neighboring orbital overlap, attributable to electron repulsion between the incoming nucleophile and the alpha position halogen. These findings also are consistent with experiments reported in the following literature references:

Sawyer, D. T.; Gibian, M. J.; "The Chemistry of Superoxide Ion", *Tetrahedron*, 1979, 35, 1471.

Merritt, M. V.; Sawyer, D. T.; "Electrochemical Studies of the Reactivity of Superoxide Ion with Several Alkyl Halides in Dimethyl Sulfoxide", *J. Org. Chem*, 1980, 35, 2157.

Dietz, R.; Forni, A. E. G.; Larcombe, B. E.; Peover, M. E.; "Nucleophilic Reactions of Electrogenerated Superoxide Ion", *J. Chem. Soc.*, B, 1980, 816.

San Fillipo, J., Jr.; Romano, L. J.; Chern, C.-I.; Valentine, J. S., "Cleavage of Esters by Superoxide", *J. Org. Chem.*, 1976, 41, 586.

Magno, F.; Bontempelli, G.; "On the Reaction Kinetics of Electrogenerated Superoxide Ion with Aryl Benzoates", *J. Electroanal. Chem.*, 1976, 68, 337

Gibian, J. J.; Sawyer, D. T.; Ungermann, T.; Tangpoonpholvivat, R.; Morrison, M. M., "Reactivity of Superoxide Ion with Carbonyl Compounds in Aprotic Solvents", *J. Am. Chem. Soc.*, 1979, 101, 640.

Magno, F.; Seeber, R.; Valcher, S., "A Study of the Reaction Kinetics of Electrogenerated Superoxide Ion with Benzylbromide", *J. Electroanal. Chem.*, 1977, 83, 131.

Halogenated toxic wastes, of course include polyhalogenated hydrocarbons, and particularly pernicious are those compounds containing at least three halogen atoms covalently joined to a tetrahedral carbon atom. Accordingly, the diverse nature of the toxic waste mixture and the theoretically based limitation on reactivity of multi-halogen carbon atoms accentuate the formidable nature of the problem.

In accordance with the present invention, a process is provided which overcomes the foregoing problems and in particular is one which appears to fly in the face of theoretical limitations. Specifically, and surprisingly, we have discovered that when a compound has at least three halogen atoms covalently joined to a tetrahedral carbon atom, it reacts rapidly and efficiently, provided that the reactant is superoxide ion or hydroxide ion in an aprotic solvent. For example, we have discovered that the reaction of carbon tetrachloride with superoxide ion in an aprotic solvent proceeds at a reaction rate that is about 140 times faster than the reaction rate of methylene chloride with superoxide, and that chloroform is about 50 times faster in reaction rate than methylene chloride. While not desiring to be limited by any particular theory, it can be postulated that the inductive effect of the additional alpha halogen atoms unexpectedly overcomes the limiting effect of steric hindrance of the polyhalogenated carbon atom.

We have also found that an efficient method for converting toxic halides is to conduct the foregoing reaction in a controlled-potential electrolysis cell, wherein the superoxide ion is electrolytically generated in an aprotic solvent electrolyte. While it is known to electrolytically generate superoxide ion for reaction with alkyl halide in an aprotic solvent such as dimethyl sulfoxide (e.g. Merritt et al, supra), because of the constraints outlined above, such a process has not heretofore been used for the degradation or detoxification of polyhalogenated waste of the type effectively treated in accordance with the present invention.

More particularly, we provide a process for the degradation of a halogenated carbon compound capable of undergoing bimolecular nucleophilic substitution and containing at least three halogen atoms, comprising reacting the carbon compound in an aprotic solvent with a strong nucleophile selected from superoxide ion and hydroxide ion. The process is particularly suitable where at least three of the halogen atoms are covalently joined to a tetrahedral carbon atom. In a more particular embodiment, the nucleophile is electrolytically generated in an electrolytic cell fitted with an anode and a cathode and containing the aprotic solvent and an electrolyte adjacent the cathode. The halogenated carbon compound as such or dissolved in hydrocarbon solvent is introduced into the aprotic solvent in the cathode.

In a still further embodiment, specifically applicable to nucleophilic reaction with carbon tetrahalide, the aprotic solvent is dimethyl sulfoxide, the reaction forming dimethylsulfone and a carbonate which precipitates and can be separated from the reaction solution. While peroxides are known to oxygenate dimethyl sulfoxide to dimethylsulfone (Goolsby, A. D.; Saywer, D. T.; "The Electrochemical Reduction of Superoxide Ion and Oxidation of Hydroxide Ion in Dimethyl Sulfoxide", *Anal. Chem.*, 1968, 40, 83), reaction with the peroxide degradation product of carbon tetrahalide is believed unique.

BRIEF DESCRIPTION OF THE DRAWINGS

The FIGURE depicts cyclic voltammograms for the reduction of atmospheric oxygen in dimethylformamide, in the absence as well as in the presence of carbon tetrachloride and methyl chloride.

DETAILED DESCRIPTION

The present invention is based upon our discovery that superoxide and hydroxide ions react rapidly and efficiently with polyhalogenated hydrocarbons, converting them to oxygenated products and inorganic halogen ion. While not desiring to be limited to any particular theory, it is believed that the process is efficiently applicable in general to halogenated carbon compounds that contain at least three halogen atoms and are capable of undergoing bimolecular nucleophilic or concerted reductive displacement of halide ion. Accordingly, the process is applicable to such toxic halogenated carbon compounds as carbon tetrachloride, chloroform, polyhalogenated fluorocarbon refrigerants, insecticides, such as DDT, dimethoxy diphenyl trichloroethane (methoxychlor), hexachlorocyclohexane (BHC), and the gamma isomer thereof which is sometimes referred to as "Lindane", octachlorohexahydromethanoindene (Chlordane), and the like. The process is particularly applicable to halogenated carbon compounds containing at least three halogen atoms covalently joined to a tetrahedral carbon atom, such as carbon tetrachloride, chloroform, DDT and methoxychlor.

Each of the foregoing substrates are rapidly degraded by means of the primary nucleophilic or concerted reductive displacement of halide atom. The overall reaction for the substrates are multi-step processes that consume one or more superoxide ($O_2^{-}\cdot$) ions per halide to yield oxygenated products. Kinetic and electrochemical studies confirm that the initial step is rate limiting and first-order with respect to substrate and superoxide ion. As indicated above, an especially surprising result is that the relative rates of reaction for the primary rate-limiting step follows the order $CCl_4$, $CHCl_3$, p-p'-DDT, $CH_3Cl$, $CH_2Cl_2$. Second-order rate constants for reaction of $CCl_4$ and $CHCl_3$ with superoxide ion indicate that these are among the fastest nucleophilic reactions yet found for superoxide ion.

Reaction with the superoxide ion or hydroxide ion must take place in an aprotic solvent. Such solvents are well known; see Sawyer, D. T.; Roberts, J. L., Jr., *Experimental Electrochemistry for Chemists*, John Wiley & Sons, New York, 1974, pp. 167–215 (Chapter Four). Aprotic solvents generally have hydrogen bound only to carbon and are at best poor hydrogen-bond donors; they are weakly acidic and proton exchange occurs slowly. Common aprotic solvents include various amides, nitriles, chlorinated hydrocarbons, ethers and other materials; specific examples include acetone, pyridine, nitromethane, nitrobenzene, acetonitrile, benzonitrile, dimethylformamide, N-methyl-2-pyrrolidone, propylene carbonate, dimethyl sulfoxide, sulfolane, and hexamethylphosphoramide.

In accordance with a preferred embodiment, the polyhalogenated carbon compounds are reacted with superoxide ion in an electrolytic system which generates the superoxide ion in an aprotic solvent electrolyte. The resultant superoxide reacts with the polyhalogenated carbon compounds that are present in the solvent system to form oxygenated products. As electrolyte, one can use any of a variety of organic solvent-soluble electrolytes, for example, tetraethylammonium perchlorate, tetra-n-butyl-ammonium perchlorate, tetraethylammonium boron tetrafluoride, tetra-n-butyl ammonium boron tetrafluoride, tetraethylammonium bromide, tetramethylammonium chloride and tetra-n-butyl ammonium bromide.

An exemplary embodiment for the conversion of carbon tetrachloride to carbonate ion involves an electrolyte system of 0.5 M tetramethylammonium chloride in dimethyl sulfoxide. The cathode for the system can be constructed from platinum, graphite, glassy carbon, or mercury. The cathode compartment of the cell can be saturated at one atmosphere with either air or molecular oxygen. The anode can be constructed from platinum, graphite, glassy carbon, cadmium or mercury, and the anode compartment can either contain the electrolyte when cadmium or mercury is used for the electrode, or for other electrode materials, a depolarizer such as hydrazine, as known to the electrolysis art, must be added to the compartment.

A preferred approach to the utilization of the system involves introducing halogenated carbon compound wastes in a hydrocarbon solvent into the electrolysis cell. With the cathode compartment saturated with air or oxygen, the cathode potential can be set at $-1.0$ volt vs a saturated calomel electrode to generate superoxide ion. The resulting superoxide reacts with the halogenated carbon compounds. In the case of carbon tetrachloride in dimethyl sulfoxide, the products are dimethylsulfone and carbonate ion. As the degradation process progresses, the solution becomes saturated with these materials and they precipitate out as solids.

It is estimated that such an electrolyte system would consume less than 60 kcal of electrical energy per mol of treated organic halogen. For example, for carbon tetrachloride treated at 1–2 volts, about 6 Faradays per mol would be required, about 277 kcal per mol of $CCl_4$.

In the general form of the invention, as an alternative approach, chemically synthesized superoxide, for example, in the form of tetramethylammonium superoxide, can be used in an aprotic solvent; or the superoxide can be in the form of $KO_2$, which can be solubilized in dimethyl sulfoxide with the aid of dicyclohexyl-18-crown-6. Such solubilization is reported by Johnson et al, supra. One could also use a soluble hydroxide in aprotic solvent, for example, tetraethylammonium hydroxide, tetra-n-butylammonium hydroxide, or tetra-n-propylammonium hydroxide, which may be added in alcohol, e.g. methanol to the aprotic solvent.

It is known from early studies with mono and dihalides that reaction rates follow the order primary, secondary and tertiary (San Fillippo, Jr., Chern and Valentine et al, supra, Johnson et al, supra) and the order I>Br>Cl (Dietz et al, supra; Filippo, Chern and Valentine, supra; Danen et al, supra). The reaction would not likely be successful with fluorine since fluoride itself is a good nucleophile.

Referring now to the FIGURE, there is illustrated the cyclic voltametric reduction of oxygen to superoxide and the reoxidation of the latter. The solid curves illustrate reduction and reoxidation in the absence of halogenated carbon compound while the dashed line curves illustrate the effect on the process of adding carbon tetrachloride (top curve) and methyl chloride (bottom curve). Enhancement of the reduction peak implies an intermediate reaction step that generates oxygen from superoxide. Diminishment or absence of the oxidation peak from the reverse scan (due to superoxide ion) indicates that superoxide is being removed by reaction with the substrate. A comparison of the top and bottom curves also vividly illustrates the striking absence with carbon tetrachloride of reoxidation, indicating that superoxide is being completely removed by reaction, to an extent much greater than that resulting from addition of methyl chloride.

The following examples will illustrate the principle of an electrochemical system in accordance with the present invention.

EXAMPLE 1

An electrolytic cell was prepared from a 100 ml beaker fitted with a Leeds & Northrup polyethylene cover holding a platinum gauze cathode, an anode compartment which was a 10 mm inner diameter tube closed with a coarse pyrex glass frit, a gas dispersion tube, a luggin capillary holding a Ag/AgCl/tetramethylammonium chloride reference electrode, and a teflon covered stirring bar. The platinum gauze cathode was a 30 mm diameter cylinder with a height of 30 mm. The anode was a crushed platinum gauze, the anode compartment containing coarse alumina to scavenge hydrogen ions. As electrolyte and aprotic solvent, there was placed in the cell 72 ml of dimethyl sulfoxide containing 1.6 grams of tetraethylammonium perchlorate.

The electrolyte was saturated with oxygen, with stirring by magnetic stirrer. A Princeton Applied Research Corp. (PARC) model 173 potentiostat, equipped with a PARC model 179 Digital Coulometer was connected to the cell. The potential was adjusted to −1.2 volts versus the reference electrode adjusted to 0.0 volts versus a standard calomel electrode. Just before switching on the potentiostat, one ml of one molar $CCl_4$ in toluene solution was injected into the electrolyte-aprotic solvent. The initial current was about 100 milliamperes at an initial temperature, which was ambient, of approximately 24° C. After about one hour and 20 minutes, the temperature had risen to about 54° C. with a current about 140–145 ma, and 460 coulombs had passed. Twenty minutes later the cell temperature was 53° C. and the current was 82–86 ma. Electrolysis was terminated three minutes after that, after 593 coulombs had passed.

The cell was cooled in icewater to 24° C. A one ml sample was placed in a beaker with 60 ml $H_2O$ and 1.0 ml of 2 M $HNO_3$ and titrated with 0.052 M $AgNO_3$, using a silver indicator electrode (27 gauge wire) and an Ag/AgCl reference electrode isolated in a tube with a medium frit. The potential was measured with a Fluke Model 8050A digital voltmeter. Titration required 0.735 ml of the silver nitrate solution to the end point. The yield of chlorine ion per mol of $CCl_4$ was calculated as 2.7 mol $Cl^-$/mol $CCl_4$, a 68% recovery of $CCl_4$ as $Cl^-$.

EXAMPLE 2

The long duration of the experiment described in Example 1 allows loss of $CCl_4$ by volatilization of the oxygen bubbling through the electrolysis cell. The small anode compartment (about 5 ml) also can accumulate acidic products that would react with superoxide ion. Accordingly, Example 1 was repeated, but using a ten fold lower concentration of $CCl_4$, a less negative control potential, and flowing oxygen over the cell rather than rigorously bubbling oxygen through the electrolyte.

The cell was the same as described in Example 1. The electrolyte solution volume was 75 ml of dimethyl sulfoxide with 1.6 grams of tetraethylammonium chloride dissolved in it. The cathode was the same as described in Example 1. The anode was a platinum flag in the anode compartment closed with a medium frit.

The electrolyte was saturated by bubbling oxygen therethrough, then 10 coulombs of current were passed under a controlled potential of −0.90 volt vs Ag/AgCl. The gas dispersion tube was then raised so that oxygen flowed over the solution and 0.10 ml of toluene/$CCl_4$ solution was added (0.0157 g $CCl_4$). Additional current was in the range of 35–20 ma, declining gradually to approximately 15 ma as the concentration of oxygen decreased. Without bubbling, the mass transfer:

$$O_2(gas) \rightarrow O_2(solution)$$

is too slow to keep up with the mass transfer at the cathode:

$$O_2(solution) + 1e^- \rightarrow O_2^- \cdot (solution).$$

Electrolysis was terminated 48 minutes later after 59.1 coulombs had passed as measured on a PARC 179 Digital Coulometer. The current at the end of electrolysis was 10–12 ma.

A 10.0 ml sample was removed and added to a cell containing 75 ml $H_2O$ plus 1.0 ml of 2 M $HNO_3$, a silver wire indicating electrode and a AgCl/Ag/tetramethylammonium chloride reference electrode isolated in a fritted tube. Before addition of the 10 ml sample, the cell voltage was +180 mv. After addition the potential changed to +93 mv.

Titration was conducted with the same silver nitrate solution and same method as in Example 1, taking 0.952 ml of the silver nitrate solution to the end point. The yield of $Cl^-$ per mol of $CCl_4$ was calculated to be 3.5, which represents an 85% conversion of $CCl_4$. The percentage recovery was confirmed by calculating the number of coulombs of current that had passed in terms of Faradays and finding that 0.58 mol of $Cl^-$ were formed per Faraday, which is 87% of stoichiometric mol/Faraday.

EXAMPLE 3

Illustrating reaction with hydroxide, a ten microliter sample of $CCl_4$ was added to a beaker containing 69 ml dimethyl sulfoxide and 0.8 gram of tetraethylammonium perchlorate. Using a Corning triple purpose glass electrode, a Ag/AgCl-tetraethylammonium chloride reference electrode and a Beckman pH meter in the millivolt mode, the solution was titrated with 1.342 M tetraethylammonium hydroxide in methanol. Titration required 0.315 ml of the hydroxide solution to the end point, calculating as 4.15 mol of hydroxide ion per mol of $CCl_4$.

As a result of a series of experiments, the overall reactant and product stoichiometries and kinetics for the degradation of various halogenated carbon compounds by superoxide in dimethylformamide are summarized below in Table 1. In each case the halogenated carbon compound is reacted with 0.1 to 4 mM $O_2^{-}\cdot$ at 25° C. in the presence of 0.1 M tetraethylammonium perchlorate. Determinations for carbon tetrachloride and chloroform were made by incremental titration with the substrate of a known amount of superoxide ion (about 2 mM, prepared by controlled potential coulometry), the residual superoxide concentration being determined by positive-scan voltammetry after each substrate addition and equilibration. The oxygen that results from the stoichiometric combination of substrate and superoxide ion in a sealed cell has been determined by cyclic voltammetry.

In dimethyl sulfoxide, $Cl^-$ also can be determined by cyclic voltammetry. In this regard, the anodic peak for the oxidation of chloride ion occurs at plus 0.95 volt versus the standard calomel electrode (SCE) in dimethyl sulfoxide (with 0.1 M tetraethylammonium perchlorate as electrolyte). Calibration with tetraethylammonium chloride has established that the peak heights are directly proportional to concentration. The presence of hydroxide ion does not interfere because its oxidation wave is suppressed by chloride ion. The yield of oxygen has been measured by the injection of carbon tetrachloride into a sealed cell that contained superoxide ion in an argon-saturated solution and recording a negative scan voltammogram. The analysis for $Cl^-$ has been confirmed for carbon tetrachloride. and for p-p'-DDT by titration with silver nitrate after dilution of the reaction mixture with aqueous 0.02 M $HNO_3$. The stoichiometries for the substrates which react more slowly have been determined by the addition of substrate to an excess of superoxide ion or by constant current coulometric titration with superoxide ion.

TABLE I

| Ex. | Substrate (S), 0.1-5mM | $O_2^{-}\cdot$ per S | $Cl^-$ released per S | $O_2$ released per S | $K_2$, $M^{-1}s^{-1}$ |
|---|---|---|---|---|---|
| 4 | $CH_3Cl$ | 1 ± 0.2 | 1 ± 0.1 | — | 80 ± 10 |
| 5 | $CH_2Cl_2$ | 2 ± 0.4 | 2 ± 0.2 | 1.2 ± 0.3 | 9 ± 2 |
| 6 | $CHCl_3$ | 4 ± 0.5 | 3 ± 0.2 | — | 460 ± 60 |
| 7 | $CCl_4$ | 6 ± 0.5 | 4 ± 0.2 | 4.2 ± 0.3 | 1300 ± 200 |
| 8 | p-p'-DDT | 3 ± 0.5 | 2 ± 0.2 | — | 130 ± 20 |

During the course of the kinetic measurements 10–20% of the superoxide ion decomposed. Presumably, this was due to residual water and impurities in the aprotic solvents. Water would produce $OH^-$ and $HO_2^-$ via the net reaction $$2O_2^{-}\cdot + H_2O \rightarrow O_2 + HO_2^- + OH^-$$

However, these nucleophiles ($OH^-$ and $HO_2^-$), at most, would be present at a ten-fold lower concentration than $O_2^{-}\cdot$. For example, their contribution to the total reaction rate with $CCl_4$ would be less than 5% which is less than the experimental error of the measurements.

Combination of carbon tetrachloride with six equivalents of superoxide ion and dimethyl sulfoxide yields a product solution which, after dilution with water, can be titrated with aqueous HCl. The stoichiometry and titration curve are consistent with those for an authentic sample of sodium carbonate in the same medium. Because peroxides are known to oxygenate dimethyl sulfoxide to dimethylsulfone (Goolsby et al, supra), a reasonable conclusion is that the overall product from the reaction of carbon tetrachloride with excess superoxide is $CO_4^{2-}$ and that it reacts with this solvent to yield carbonate ion which is determined by the HCl titration, to wit:

$$CO_4^{2-} + DMSO \rightarrow DMSO_2 + CO_3^{2-}$$

When $CHCl_3$ is combined with four equivalents of superoxide ion, in dimethylformamide, a basic product solution is obtained. Dilution with water and titration with HCl yields a titration curve with a stoichiometry (monoprotic) and an apparent $pK_a$ (6.7) that are consistent with peroxyformate ion. (The $pK_a$ values for peroxycarboxylic acids typically are 3.2 to 3.5 units larger than the parent acid—formic in this case; $pK_a$ 3.6) The acidified product solution oxidizes $I^-$ to $I_2$, which is a further indication of a peroxide species.

On the basis of the foregoing experiments and the stoichiometries indicated in Table I, the following overall reactions are proposed:

$$CH_3Cl + O_2^{-}\cdot \rightarrow \tfrac{1}{2}CH_3O\text{-}OCH_3 + Cl^- + \tfrac{1}{2}O_2 \quad (4)$$

$$CH_2Cl_2 + 2O_2^{-}\cdot \rightarrow CH_2O + 2Cl^- + 3/2O_2 \quad (5)$$

$$CHCl_3 + 4O_2^{-}\cdot \rightarrow HC(O)OO^- + 3Cl^- + 5/2O_2 \quad (6)$$

$$CCl_4 + 6O_2^{-}\cdot \rightarrow CO_4^{2-} + 4Cl^- + 4O_2 \quad (7)$$

$$\text{p-p'-DDT} + 3O_2^{-}\cdot \rightarrow \text{products} + 2Cl^- + 3/2O_2 \quad (8)$$

The second-order rate constants summarized in Table I have been determined by addition of substrate to superoxide ion in a dimethylformamide solution and monitoring the rate of disappearance of superoxide ion with a rotating platinum-disk electrode; at a control potential of −0.3 volt vs SCE the current is directly proportional to the instantaneous concentration of superoxide. The reaction rates for $CCl_4$ and $CHCl_3$ were measured under second-order conditions with an excess of superoxide ion present. For the slower reactions of $CH_2Cl_2$ and $CH_3Cl$ with superoxide ion, the rates were measured under pseudo first-order conditions by the use of an excess of substrate.

The data for $CH_3Cl$ in Table I are in accord with previous studies of the reactivity of superoxide ion with n-alkyl halides; the value of the rate constant (80 $M^{-1}s^{-1}$) is 25 times greater than the value for n-BuCl in dimethyl sulfoxide (Merritt et al, supra). Likewise, previous kinetic data for the reaction of superoxide ion with methylene bromide and related halides confirm the order of reactivity for $CH_2Cl_2$ and $CH_3Cl$ in Table I, $CH_3Br$ reacting 50 times faster than $CH_2Br_2$ with superoxide ion (Danen et al, supra). These data and the data for the other substrates in Table I are consistent with the conclusion that the primary step (first-order in superoxide ion and first-order in substrate) for all of the substrates is rate-limiting and occurs via a primary nucleophilic or concerted reductive displacement of chloride ion.

The observed order of reactivity and the fact that the rate constant for $CCl_4$ is much larger than that for $CH_3Cl$ are surprising. As discussed above, the presence of four leaving groups rather than one would not be expected to overcome the greater steric hindrance for inversion that is present with $CCl_4$. Apparently, the enhanced electrophilicity of the carbon atom in $CCl_4$ is the basis for its exceptional reactivity with superoxide in aprotic media. The same steric and electrophilic trends with increasing numbers of halogen atoms can account for the enhanced reactivity of $CHCl_3$ and for the minimum in reactivity for the dihalomethanes.

While Table I and the reaction schemes have been developed for reaction with superoxide ion, in accordance with another embodiment of this invention, one can alternatively use hydroxide ion which, we have discovered, also reacts rapidly with the polyhalogenated carbon compounds in aprotic solvent. For example, the reaction of hydroxide ion with $CCl_4$ is so rapid in dimethyl sulfoxide that the halide can be titrated with a stoichiometry of four mol of $OH^-$ per mol of $CCl_4$. The ultimate product presumably is $CO_2$, which probably cannot be further titrated to $CO_3^{2-}$ in dimethyl sulfoxide.

In the presence of a four-fold excess of $OH^-$, the rate of disappearance of superoxide ion by reaction with $CCl_4$ is measurably reduced. Analysis of the kinetics for such experiments indicates that the assumed second-order rate constant for the $(OH^- + CCl_4)$ reaction is $0.7 \pm 0.3$ of that for the $(O_2^{-}\cdot + CCl_4)$ reaction.

For the solution conditions of Table I, thiocyanate ion ($SCN^-$) (one of the best nucleophiles known—Sawyer et al, supra, p. 1476) does not react to a significant extent with $CCl_4$ in dimethyl sulfoxide (second-order rate constant $< 10^{-2} M^{-1} s^{-1}$). Hence, $O_2^{-}\cdot$ and $OH^-$ appear to be unique, exceptionally strong nucleophiles with respect to their reactivity toward the polyhalogenated carbon compounds in aprotic media.

Although strong bases are known to eliminate HCl from $CHCl_3$ and p-p'-DDT via an $S_Nl_cB$ mechanism to give dichlorocarbene and $(p\text{-}Cl\phi)_2C{=}CCl_2$, (March, J. *Advanced Organic Chemistry,* 2nd ed.; McGraw-Hill: New York, 1977: pp. 342–343), there is no evidence that such processes are competitive with the primary nucleophilic displacement reactions of Table I. However, the stoichiometry for the reaction of p-p'-DDT indicates that only two of the three alkylchloro atoms are removed. Hence, subsequent to the first step, there may be a dehydrohalogenation to give a chloro substituted alkene. Such a product may have limited reactivity with superoxide ion; for example, 1,1,2-trichloroethene (trichloroethylene) reacts extremely slowly.

On the basis of the data of Table I, the preceding discussion and the generally accepted mechanism for reaction of superoxide ion with n-alkyl halides (Dietz et al, supra), to wit:

$$RX + O_2^{-} \rightarrow RO_2\cdot + X^-$$

$$RO_2\cdot + O_2^{-} \rightarrow RO_2^- + O_2$$

$$RO_2^- + RX \rightarrow ROOR + X^-$$

a reasonable and self-consistent mechanism for the $O_2^{-}$—$CCl_4$ reaction in dimethylformamide can be proposed:

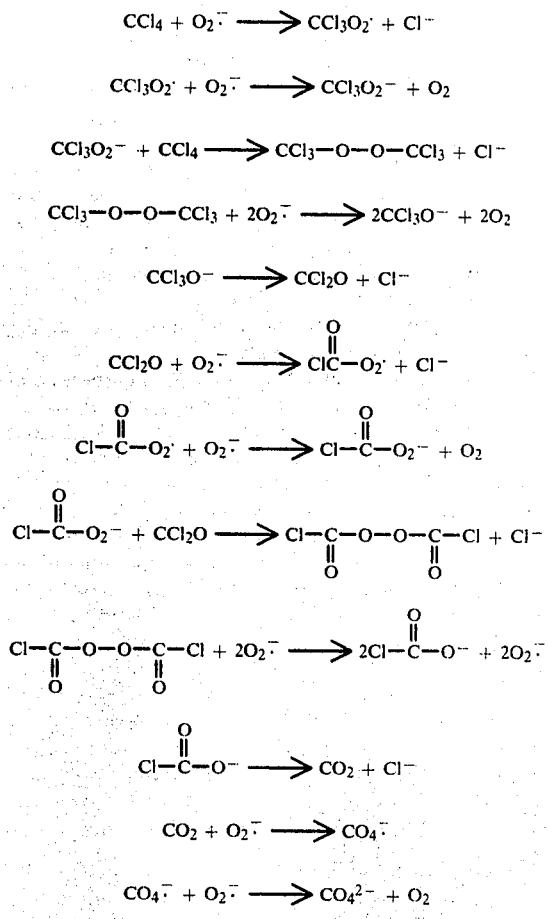

The last two steps have been observed in previous studies (H. A. L. Hill, private communication, Oxford University, 1978—referred to in Sawyer et al, supra, at p. 1477). As above indicated, when $O_2^{-}\cdot$ and $CCl_4$ are combined in dimethyl sulfoxide, the $CO_4^{2-}$ product reacts with the solvent to yield dimethylsulfone and $CO_3^{2-}$ as the final products.

Analogous mechanistic pathways to the above equations are proposed for the other substrates of Table I and account for the products, stoichiometries, and overall reactions. There is no evidence that the C-H bond of $CHCl_3$ is broken or that aromatic chlorides (p-p'-DDT) are displaced within the time frame of our experiments (less than one hour). Likewise, the results do not support a direct electron-transfer from $O_2^{-}\cdot$ to the substrate as the primary step. Carbon tetrachloride in dimethylformamide is reduced at platinum and glassy carbon electrodes at potentials (−1.3 volts vs SCE) appreciably more negative than $O_2$. Such a mechanism is even less likely for $CHCl_3$ which is reduced at a potential that is 0.4 volt more negative than $CCl_4$.

There is a question as to whether this superoxide chemistry occurs in biology as a means to detoxify halogenated hydrocarbons and pesticides that are concentrated in the lipids, a prospect if the organism has the means to generate superoxide at the lipophilic-hydrophilic interface of the membrane. It has been suggested ("Oxygen Free Radicals and Tissue Drainage" Slater, T. F.; *Ciba Foundation Symposium* 65, Elsevier/North Holland; New York, 1979. pp. 143–163) that the hepatotoxicity of $CCl_4$ is due to a $CCl_4$-stimulated peroxidation of unsaturated fatty acids via the $Cl_3CO_2\cdot$ radical. Because this species is believed to be the primary product for the reaction of superoxide with $CCl_4$ in aprotic media, similar chemistry may occur with in vivo generated superoxide and represent the mechanism of $CCl_4$ toxicity.

We claim:

1. A process for the degradation of an aliphatic carbon containing compound containing at least three halogen atoms selected from iodine, bromine and chlorine, on the same aliphatic carbon, said carbon compound being capable of undergoing bimolecular and nucleophilic substitution, comprising reacting said carbon compound with superoxide in an aprotic solvent which is essentially free of water.

2. The process of claim 1 in which said carbon compound comprises a saturated aliphatic hydrocarbon.

3. A process for the degradation of a halogenated carbon compound capable of undergoing bimolecular nucleophilic substitution and containing three halogen atoms, selected from iodine, bromine and chlorine, covalently joined to a tetrahedral carbon atom, comprising reacting said carbon compound with superoxide in an aprotic solvent which is essentially free of water.

4. The process of claim 1 or 3 in which said superoxide is electrolytically generated in an electrolytic cell fitted with an anode and a cathode and containing said aprotic solvent adjacent said cathode, said aprotic solvent containing an electrolyte soluble therein.

5. The process of claim 4 including the step of introducing said halogenated carbon compound into said aprotic solvent adjacent said cathode and generating superoxide ion at said cathode to react with said carbon compound.

6. The process of claim 5 in which said carbon compound is introduced in a hydrocarbon solvent therefor.

7. The process of claim 3 in which said carbon compound is a carbon tetrahalide.

8. The process of claim 7 in which said carbon tetrahalide is carbon tetrachloride.

9. The process of claim 7 or 8 in which said aprotic solvent is dimethy sulfoxide.

10. The process of claim 3 in which said carbon compound is chloroform.

11. The process of claim 3 in which said carbon compound comprises a saturated aliphatic hydrocarbon.

12. The process of claim 11 in which said carbon compound is p-p'-dichloro-diphenyl-trichloroethane.

13. A process for the electrolytic degradation of carbon tetrachloride, comprising:

providing an electrolytic cell fitted with an anode and a cathode and containing dimethyl sulfoxide adjacent said cathode, said dimethyl sulfoxide being essentially free of water and containing an electrolyte soluble therein;

adding said carbon tetrachloride and a hydrocarbon solvent to said dimethyl sulfoxide;

electrolytically generating superoxide ion at said cathode to react with said carbon tetrachloride and form a peroxide degradation product thereof, said peroxide degradation product reacting with said dimethyl sulfoxide to form dimethylsulfone and a carbonate; and removing said dimethylsulfone and said carbonate from said electrolytic cell.

14. A process for the degradation of a hexahalocyclohexane containing halogen atoms selected from iodine, bromine and chlorine, said hexahalocyclohexane being capable of undergoing bimolecular nucleophilic substitution, comprising reacting said hexahalocyclohexane with superoxide in an aprotic solvent which is essentially free of water.

* * * * *